US010196782B2

(12) United States Patent
Jacobsson

(10) Patent No.: US 10,196,782 B2
(45) Date of Patent: Feb. 5, 2019

(54) CONTINUOUS ACTION SPIKE PULLER FOR RAIL APPLICATIONS

(71) Applicant: HARSCO TECHNOLOGIES LLC, Fairmont, MN (US)

(72) Inventor: Kent Jacobsson, Hällnäs (SE)

(73) Assignee: HARSCO TECHNOLOGIES LLC, Fairmont, MN (US)

( * ) Notice: Subject to any disclaimer, the term of this patent is extended or adjusted under 35 U.S.C. 154(b) by 278 days.

(21) Appl. No.: 15/276,045

(22) Filed: Sep. 26, 2016

(65) Prior Publication Data

US 2017/0096781 A1 Apr. 6, 2017

Related U.S. Application Data

(60) Provisional application No. 62/235,747, filed on Oct. 1, 2015.

(51) Int. Cl.
*E01B 29/26* (2006.01)

(52) U.S. Cl.
CPC ..... *E01B 29/26* (2013.01); *E01B 2203/00* (2013.01)

(58) Field of Classification Search
CPC ..... E01B 29/00; E01B 29/04; E01B 29/24; E01B 29/26; E01B 29/28; E01B 29/29
See application file for complete search history.

(56) References Cited

U.S. PATENT DOCUMENTS

| | | | | |
|---|---|---|---|---|
| 3,690,264 | A * | 9/1972 | Plasser | E01B 29/24 104/17.1 |
| 5,924,679 | A | 7/1999 | Wilson | |
| 2007/0113752 | A1 | 5/2007 | Eldridge | |
| 2012/0199037 | A1 | 8/2012 | Miller et al. | |
| 2014/0260643 | A1 | 9/2014 | Delmonico | |

FOREIGN PATENT DOCUMENTS

| | | |
|---|---|---|
| WO | 2012142548 | 10/2012 |

OTHER PUBLICATIONS

International search report and written opinion of the international searching authority for co-pending PCT application No. PCT/US2016/053727 dated Jan. 11, 2017.

* cited by examiner

*Primary Examiner* — Robert J McCarry, Jr.
(74) *Attorney, Agent, or Firm* — Baker & McKenzie LLP

(57) ABSTRACT

The present disclosure generally relates to a rail vehicle having a frame and a carriage assembly coupled to the frame. The carriage assembly includes at least one workhead coupled thereto. The workhead includes a jaw member that is operable to engage and remove rail spikes during rail maintenance operations. Further, the carriage assembly and workhead are operable to move longitudinally along the frame and relative to the frame.

11 Claims, 6 Drawing Sheets

CONTINUOUS ACTION SPIKE PULLER FOR RAIL APPLICATIONS

CROSS-REFERENCE TO RELATED APPLICATION

This application claims priority to U.S. Provisional Application No. 62/235,747, filed on Oct. 1, 2015, which is hereby incorporated by reference.

BACKGROUND

Railroads are typically constructed to include a pair of elongated, substantially parallel rails, which are coupled to a plurality of laterally extending ties. The ties are disposed on a ballast bed of hard particulate material, such as gravel. Over time, normal wear and tear on the railroad may require track maintenance operations to correct rail deviations.

Rail vehicles for track maintenance operations include workheads for performing the desired track maintenance, such as ballast tamping, spike pulling, spike driving, anchor spreading, anchor squeezing, track stabilizing, crib booming, tie extracting, or other maintenance operations. With respect to spike pullers, the process for pulling and replacing spikes can be cumbersome given the need to stop at each tie having spikes that need to be removed. Accordingly, an improved spike puller apparatus that allows for continuous action or substantially continuous action is desired. Related methods of identifying the location of spikes to be pulled are described.

BRIEF SUMMARY

The present disclosures relates to a rail vehicle for performing rail maintenance operations. The rail vehicle includes a frame and at least one workhead assembly for pulling rail spikes mounted on the frame. The workhead assembly is coupled to a guide rod that allows for longitudinal movement of the workhead assembly along the guide rod and relative to the rail frame. In this manner, the rail vehicle may be operated in a continuous mode in which the rail vehicle continually moves along the track during spike pulling operations. The rail vehicle further includes a mechanical tie finder for detecting a rail tie. Upon detecting a tie, a signal is sent to the workhead to engage and pull one or more spikes corresponding to the detected tie. Related methods are described.

BRIEF DESCRIPTION OF THE DRAWINGS

Exemplary embodiments of the invention are described herein with reference to the drawings, wherein like parts are designated by like reference numbers, and wherein.

DETAILED DESCRIPTION

Various embodiments of an improved rail maintenance vehicle for providing continuous action spike pulling are described. It is to be understood, however, that the following explanation is merely exemplary in describing the devices and methods of the present disclosure. Accordingly, several modifications, changes, and substitutions are contemplated.

Figure 1:
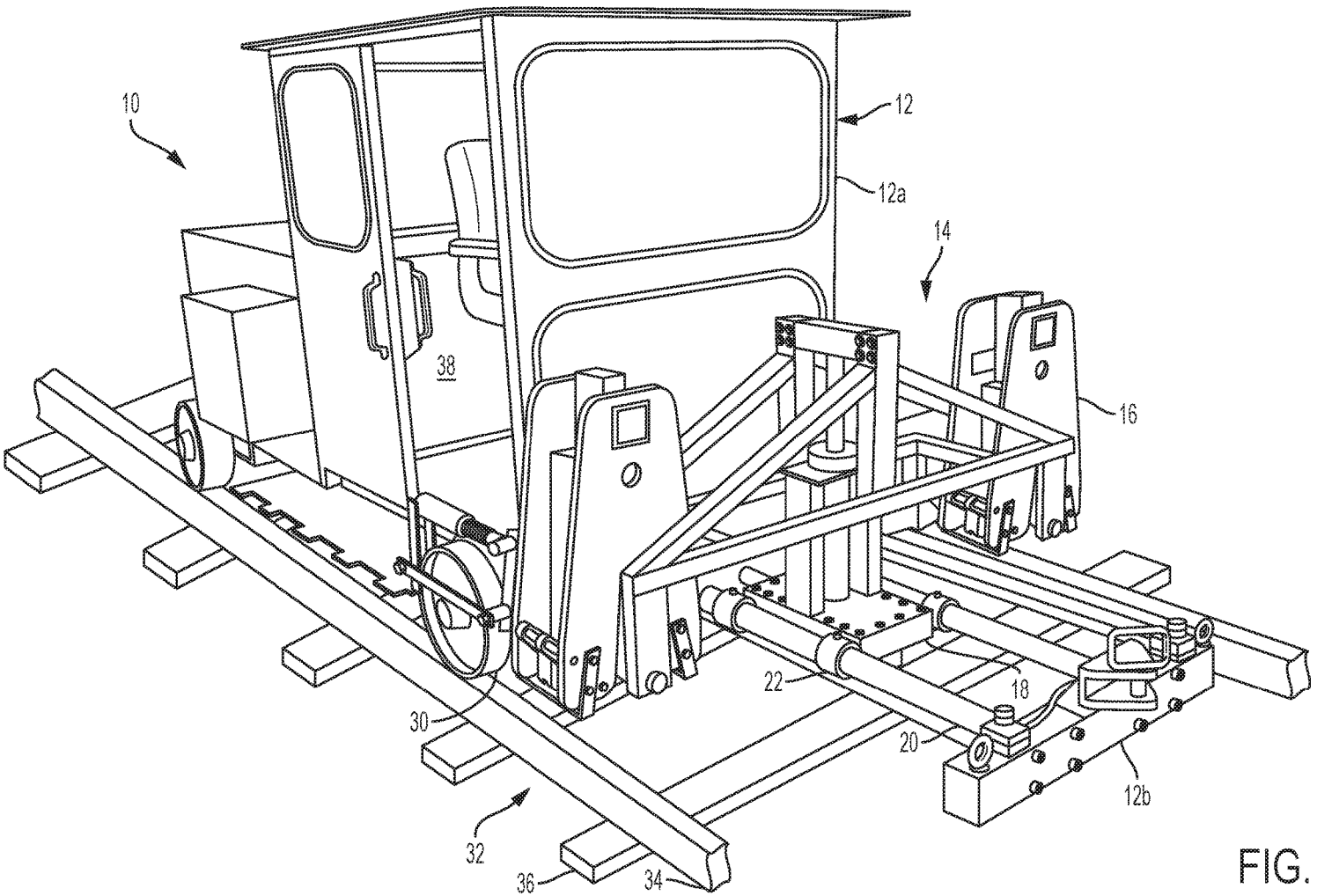
FIG. 1 illustrates a perspective of a rail vehicle for performing rail maintenance operations according to one embodiment of the present disclosure.

Referring to FIG. 1, a rail maintenance vehicle having workheads for conducting spike pulling operations is depicted as having reference numeral 10. While depicted as having workheads for spike pulling operations, it is to be appreciated that the rail vehicle 10 may carry workheads for other rail maintenance purposes. The rail vehicle 10 includes a frame 12 and a carriage assembly 14 that carries workheads 16 for performing rail maintenance operations. The carriage assembly 14 is operatively coupled to the rail vehicle frame 12 via a subframe member 18 and a pair of guide rods 20 that allow for longitudinal displacement of the carriage assembly along and relative to the frame. In this regard, the subframe member 18 includes a plurality of connectors 22 that receive the guide rods 20 in cavities defined by the connectors. Thus, actuation (e.g., via a hydraulic cylinder) of the subframe member 18 causes the subframe member, and the carriage assembly 14, to move along the guide rods and relative to the frame 12 via the connectors 22.

It is to be appreciated that the guide rods 20 are fixed relative to the frame 12 and are coupled between a main frame portion 12*a* and an end frame portion 12*b* positioned a longitudinally from the main frame portion. The guide rods 20 may also be considered part of the frame 12. Further, as illustrated in FIG. 1, the guide rods 20 extend from a lower end of the main frame portion 12*a* such that the carriage assembly 14 and workheads 16 are positioned above the guide rods when the carriage assembly and workheads translate along the guide rods as will be described.

The rail vehicle 10 further includes a plurality of rail wheels 30 for traveling along track 32, which is comprised of longitudinally extending rails 34 and a series of ties 36 underlying the rails. The rail vehicle may also include an operator cab 38; however, in some embodiments, the rail vehicle 10 may be operated as a drone vehicle with no human operator in the vehicle.

Figure 2:
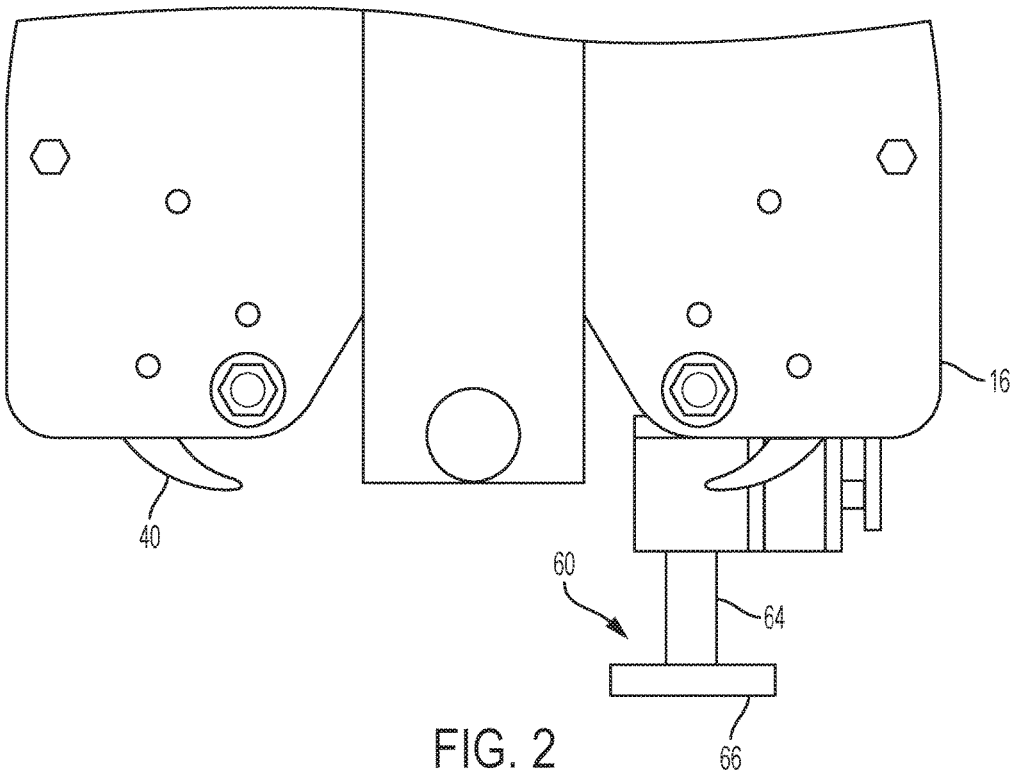
FIG. 2 illustrates a front view of the workhead assembly associated with the rail vehicle of FIG. 1.
Figure 3:
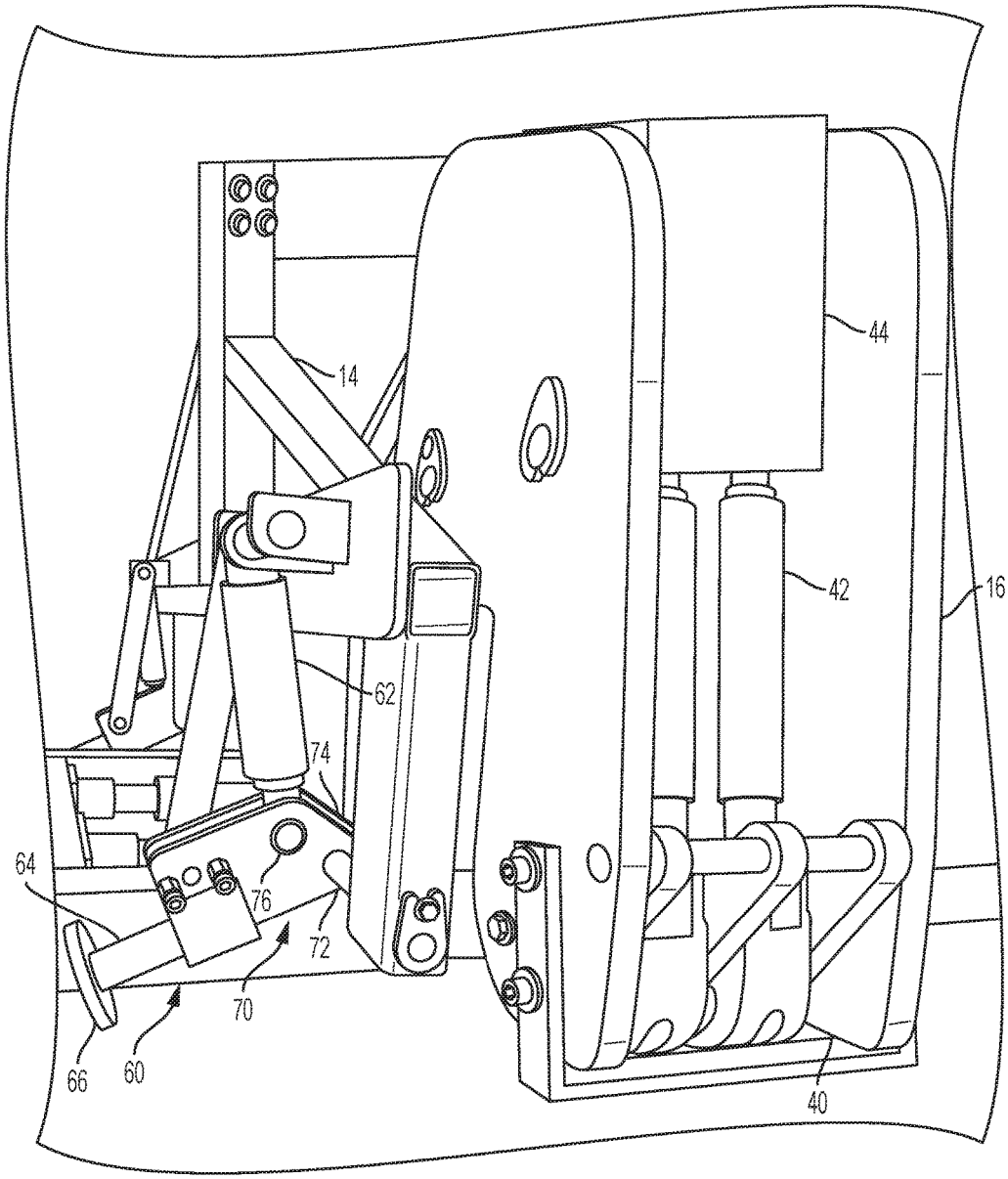
FIG. 3 illustrates a side perspective view of the workhead assembly and tie finder associated with the rail vehicle of FIG. 1.
Figure 4:
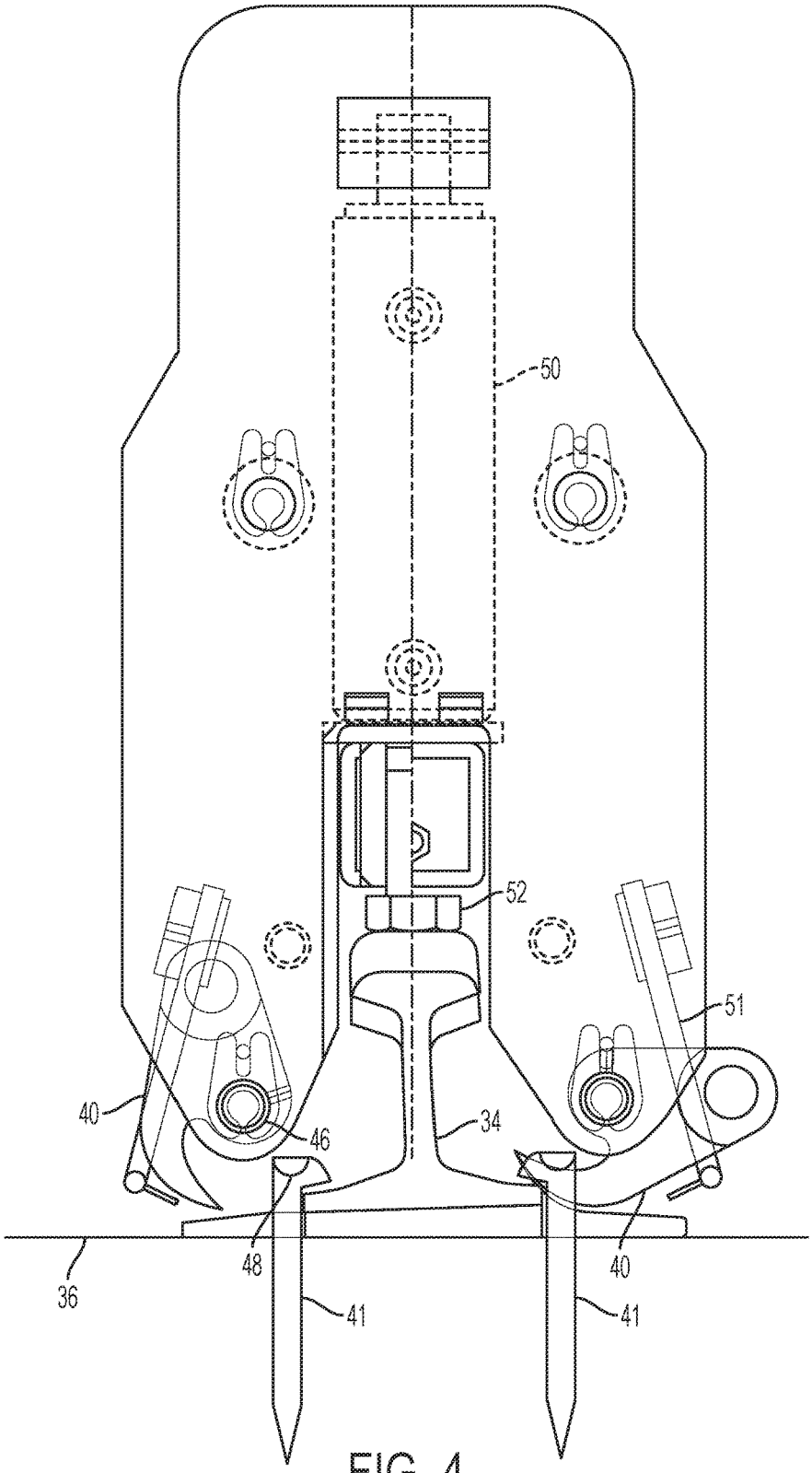
FIG. 4 illustrates a front schematic view of the workhead assembly associated with the rail vehicle of FIG. 1.
Figure 5:
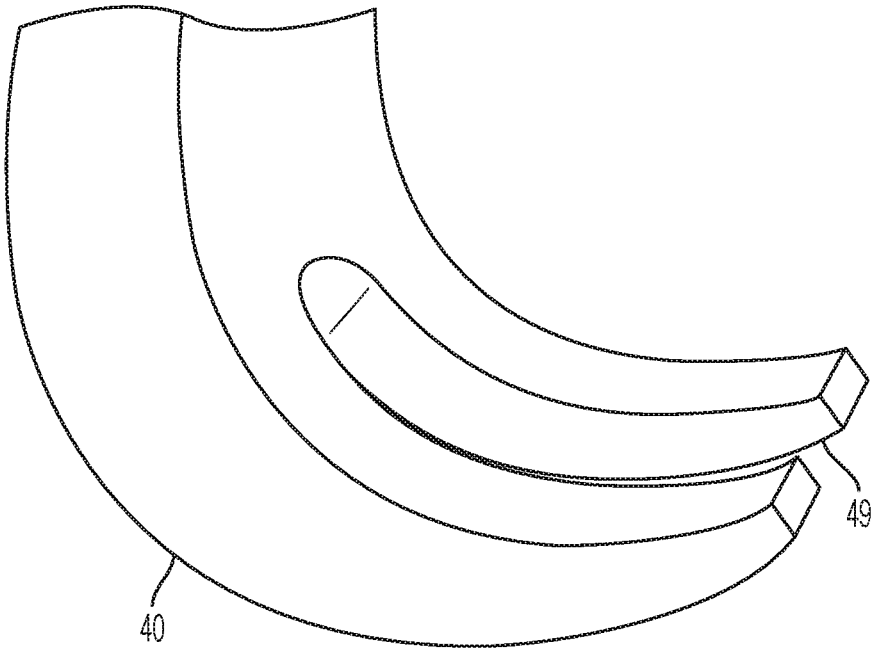
FIG. 5 illustrates a jaw member associated with the workhead assembly.

Referring to FIGS. 2-4, the workheads 16 include jaw members 40, which may be actuated to engage and pull rail spikes (reference numeral 41 in FIG. 4). The jaw members 40 may be actuated via hydraulic cylinders 42, which are disposed between an upper portion 44 of the workheads 16 and the corresponding jaw members. As shown in FIG. 4, the jaw members may be deployed from a disengaged position (left jaw member as shown in FIG. 4) to an engaged position (right jaw member as shown in FIG. 4) in order to engage and thereby remove rail spikes 41. The jaw members 40 are configured to pivot about pivot members 46 disposed within the workheads 16 via actuation of the corresponding hydraulic cylinders 42. In this manner, and as illustrated in FIG. 4, the jaw member 40 can engage a flange portion 48 of the rail spike 41 that extends longitudinally (in the direction of the rail 34). Referring to FIG. 5, the jaw member 40 may take the form of a two-pronged member that defines a groove 49 for abutting and engaging the flange 48 of the rail spike 41 to thereby disengage the rail spike in spike pulling operations. The workheads 16 may further be equipped with abutment members 51, which assist with dislodging the rail spikes 41 from the jaw members 40. As the jaw members 40 move back into the disengaged position with the rail spikes 41, the abutment members 51 provide a surface against which the rail spikes 41 may be scraped off the jaw members to thereby dislodge the rail spikes from the jaw members.

Referring again to FIG. 4, each workhead 16 further includes a hydraulic cylinder 50 for imparting vertical movement to the workhead to thereby position the jaw members 40 for spike pulling operations. To assist with position setting, a stop member 52 may be disposed centrally at a lower portion of the workhead 16 such that it comes into contact with the rail 34 upon reaching the desired position for actuation of the jaw members 40.

Referring to FIGS. 2-4, the carriage assembly 14 further includes a detector 60 for identifying ties 36 during spike pulling operations. The detector 60 may take the form of a mechanical tie finder. The tie finder 60 is movable from a retracted position (FIG. 3) to a deployed position (FIG. 2) via a hydraulic cylinder 62 operably coupled to the tie finder. The hydraulic cylinder 62 may be coupled between the carriage assembly 14 and the tie finder 60. In one embodiment, the tie finder 60 is formed of a stem portion 64 and a flange portion 66.

The tie finder 60 may be operatively coupled to the hydraulic cylinder 62 through a coupling assembly 70. In one embodiment, the coupling assembly 70 includes two plates 72, 74, which receive a distal connecting member 76 of the hydraulic cylinder 62. In this manner, extension of the hydraulic cylinder 62 causes the tie finder 60 to rotate down into the engaged position, which is substantially orthogonal to the longitudinal axis of the track as measured along the stem portion of 64 of the tie finder. Retraction of the hydraulic cylinder 62 causes the tie finder 60 to rotate up into a disengaged position, which may be parallel to or oblique to the longitudinal axis of the track as measured along the stem portion 64 of the tie finder.

In practice, continuous action spike pulling may be achieved by using the detector 60 in combination with the workheads 16. When proceeding down the track 32, the detector 60 may be deployed into the engaged position in the space between ties 36 as the rail vehicle 10 proceeds along the track at a desired speed. Upon touching or approaching a tie 36, the detector 60 may send a signal to the workheads 16 to proceed with spike pulling operations. Once the detector 60 identifies the presence of a tie 36, the workhead carriage assembly 14 is lowered towards the track 32 at an appropriate distance from the tie and the workheads 16 are then actuated such that the jaw members 40 engage and extract the spikes 41. The detector 60 is then retracted, and the rail vehicle 10 continues to continuously move down the tracks towards a next crosstie. In some embodiments, the detector 60 is retracted before or substantially simultaneously with actuation of the jaw members 40.

During the spike pulling operation, the rail vehicle 10 may continuously move down the track 11. Such movement is permitted as the workhead carriage assembly 14 may be longitudinally displaced along the rail vehicle frame 12 via movement along the guide rods 20. Such movement may be carried out via a hydraulic cylinder that may be actuated to move the carriage assembly 14 in a longitudinal direction and relative to the frame 12. The carriage assembly 14 and workheads 16 are positioned above the guide rods during such longitudinal movement. Accordingly, upon performing spike pulling operations, the workhead carriage assembly 14 may be lifted and translated forward along the frame 12 such that it is ready to be positioned over the next tie to be worked. Also, since the detector 60 is in a retracted position, it does not interfere with the previous tie worked when the carriage workhead assembly 40 is moved forward relative to the rail vehicle frame 12. Once the carriage workhead assembly 40 is moved forward to the front of the rail vehicle frame 12, the detector 60 may be redeployed to into its engaged position such that it is ready to find the next tie. Once the next tie is detected, the carriage workhead assembly is again lowered into its working position such that spike pulling operations may commence.

The detector will then be deployed between the finished crosstie and a next crosstie. When the detector 60 identifies the next tie 36, the above described spike pulling process is repeated, and continuous action spike pulling is achieved. The spike puller described herein is continuous action in the sense that it does not stop at each tie, but rather progresses slowly along the rails in a continuous fashion while allowing for spike pulling by the workheads at each tie. In some embodiments, the term "continuous action" may refer to rail maintenance vehicles that are in constant motion during operations, or in other embodiments, it may refer to rail maintenance vehicles that are substantially in constant motion, yet experience brief, intermittent stops during operations.

Figure 6:
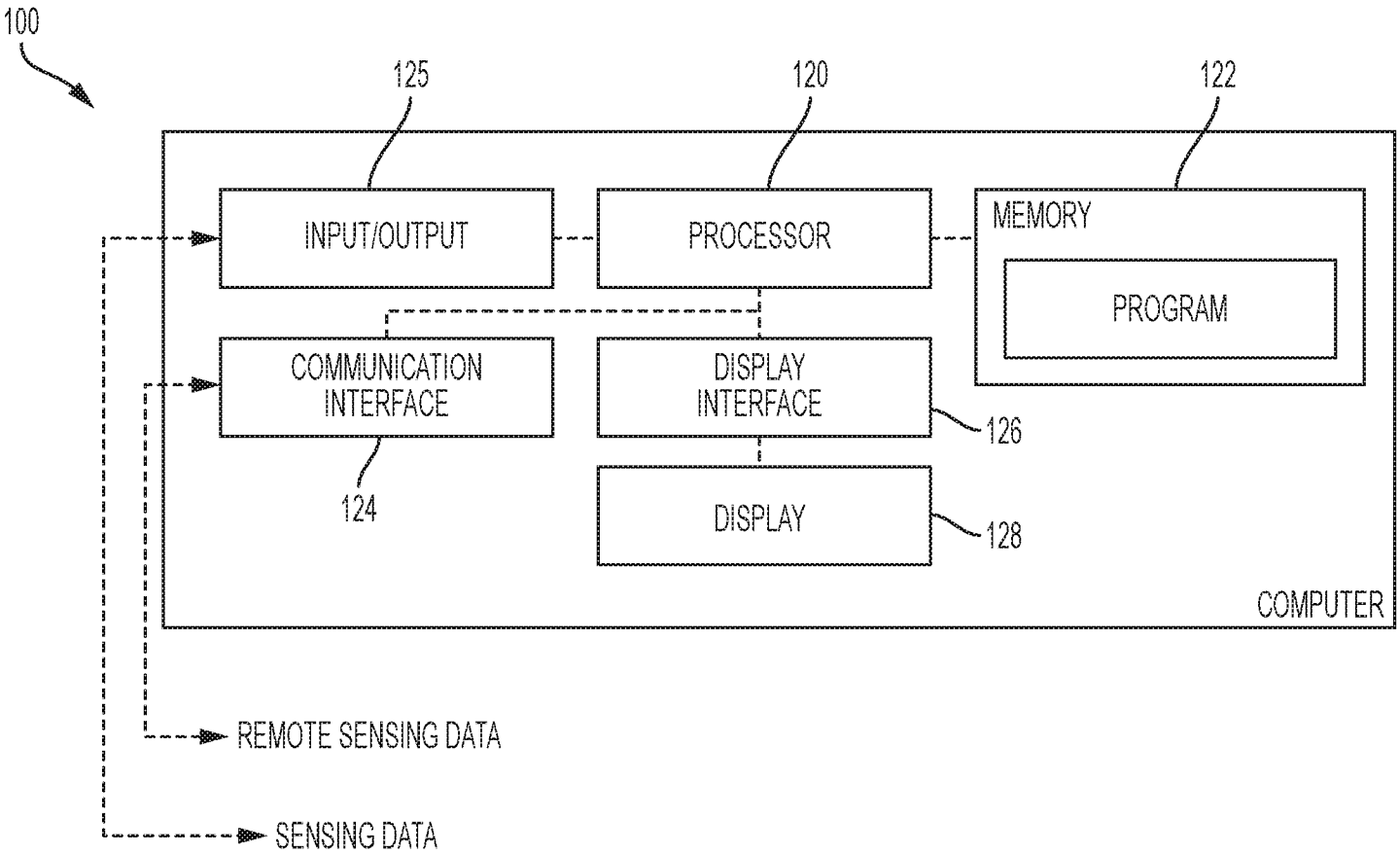
FIG. 6 illustrates a computing system associated with the rail vehicle of FIG. 1.

Referring to FIG. 6, the rail vehicle 10 may be equipped with a computing system may take the form of a computer or data processing system 100 that includes a processor 120 configured to execute at least one program stored in memory 122 for the purposes of performing one or more of the processes disclosed herein. The processor 120 may be coupled to a communication interface 124 to receive remote sensing data, such as detection of a tie, as well as transmit instructions to receivers distributed throughout the rail vehicle 10, such as to the workheads to commence spike pulling operations. The processor 120 may also receive and transmit data via an input/output block 125. In addition to storing instructions for the program, the memory may store preliminary, intermediate and final datasets involved in techniques that are described herein. Among its other features, the computing system 100 may include a display interface 126 and a display 128 that displays the various data that is generated as described herein. It will be appreciated that the computing system 100 shown in FIG. 6 is merely exemplary in nature and is not limiting of the systems and methods described herein.

While various embodiments in accordance with the disclosed principles have been described above, it should be understood that they have been presented by way of example only, and are not limiting. Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

I claim:

1. A rail vehicle, comprising:

a frame;

a carriage assembly operatively coupled to the frame; and at least one workhead coupled to the carriage assembly, the workhead having a jaw member for removing rail spikes;

a detector coupled to the carriage assembly, the detector being operable to move from a first, disengaged position to a second, engaged position, wherein the detector is operable to detect a tie when in the second, engaged position; and an onboard computing system operable to receive a signal when a tie is detected and cause the workhead to lower into position adjacent a rail spike; and wherein the carriage assembly is operable to move longitudinally along the frame and relative to the frame.

2. The rail vehicle of claim 1, wherein the frame includes a main frame portion and an end frame portion, the rail vehicle further comprising a pair of guide rods coupled between the main frame portion and then end frame portion.

3. The rail vehicle of claim 2, further comprising a subframe member coupled to the guide rods and operable to move along the guide rods in a longitudinal direction.

4. The rail vehicle of claim 3, wherein the carriage assembly is coupled to the subframe member.

5. The rail vehicle of claim 3, wherein the subframe members includes a plurality of connectors coupled thereto, the connectors being received onto the guide members to provide for coupling of the subframe member to the guide rods.

6. The rail vehicle of claim 4, wherein the at least one workhead comprises two workheads, each workhead being disposed laterally of the guide rods.

7. The rail vehicle of claim 6, wherein the carriage assembly includes an actuator to permit vertical movement of the carriage assembly and the workhead relative to the rail vehicle frame.

8. The rail vehicle of claim 7, wherein the rail vehicle travels along a pair of rails, and wherein each workhead is positioned over each rail.

9. A method for performing rail maintenance operations on a railroad track having a pair of longitudinally extending rails and a plurality of ties underlying the rails, the ties being secured to the rails via a plurality of rail spikes, the method comprising:

providing a rail vehicle having:

a frame member;

a carriage assembly operatively coupled to the frame; and at least one workhead and a tie detector coupled to the carriage assembly, the workhead having a jaw member;

continuously advancing the rail vehicle along the rails;

deploying the tie detector from a first, disengaged position to a second, engaged position and detecting a tie of the plurality of ties when the tie detector is in the second, engaged position;

upon detecting the tie, sending a signal to an onboard computing system to cause the the workhead to lower into position adjacent a rail spike associated with the tie;

actuating the jaw member to engage and remove the rail spike; and upon completing removal of the spike, raising the workhead and translating the carriage assembly forward along the frame and relative to the frame.

10. The method of claim 9, wherein upon removal of the rail spike, the detector is deployed from the second, engaged position to the first, disengaged position.

11. The method of claim 10, further comprising continuously advancing the rail vehicle to the next tie.

* * * * *